United States Patent [19]

Goldman

[11] 4,068,313

[45] Jan. 17, 1978

[54] ARTICLE OF CHIDRENS PROTECTIVE CLOTHING IN COMBINATION WITH AN ARTICLE OF USE

[76] Inventor: Diana Goldman, Tower East Apt. 22B, 190 E. 72nd St., New York, N.Y. 10021

[21] Appl. No.: 737,906

[22] Filed: Nov. 2, 1976

[51] Int. Cl.[2] ..... A41B 13/10

[52] U.S. Cl. ..... 2/49 R

[58] Field of Search ..... 2/49 R, 48, 52; 24/68 T, 16 PB, 72.7, 3 M, 3 R, 201 A

[56] References Cited

U.S. PATENT DOCUMENTS

| | | | |
|---|---|---|---|
| 255,480 | 3/1882 | Webb | 24/201 A X |
| 1,411,091 | 3/1922 | Hanney | 24/72.7 X |
| 1,673,327 | 6/1928 | Hahn | 24/201 A X |
| 1,816,566 | 7/1931 | Burstein et al. | 2/48 |
| 2,410,639 | 11/1946 | Dorcey | 2/48 |
| 2,552,462 | 5/1951 | Savrin | 2/49 R |
| 3,100,923 | 8/1963 | Loughman | 24/72.7 X |
| 3,184,883 | 5/1965 | McCook | 2/49 R X |
| 3,602,916 | 9/1971 | Aach | 2/52 X |

FOREIGN PATENT DOCUMENTS

| | | | |
|---|---|---|---|
| 701,336 | 1/1965 | Canada | 24/16 PB |

*Primary Examiner*—Alfred R. Guest
*Attorney, Agent, or Firm*—Rose & Edell

[57] ABSTRACT

An article of childrens protective clothing, such as a bib in combination with an article of use. The article, which may be a toy or eating implement, is permanently attached to one end of a cord which has means at its other end for the engagement in an opening in the protective clothing. The means at the end of the cord may take the form of a toggle engaging in the opening to releasably secure the article of use to the protective clothing.

6 Claims, 4 Drawing Figures

ARTICLE OF CHIDRENS PROTECTIVE CLOTHING IN COMBINATION WITH AN ARTICLE OF USE

This invention relates to an article of childrens protective clothing such as a bib or an apron in combination with an article of use.

BACKGROUND OF THE INVENTION

It is well known that young children in the development stage have a tendency to drop or throw down their toys, eating implements and so on, either out of sheer cantankerousness or through lack of control. This means, of course, that somebody has to be on hand to retrieve the lost object and, in the case of eating implements, to clean the object before its return.

SUMMARY OF THE INVENTION

The invention aims to avoid this difficulty and to provide an article of childrens protective clothing having in combination therewith a cord (as herein defined) having an article of use such as a toy, or eating implement permanently attached to one end, which cord has at its other end means for attachment to the protective clothing by the engagement of the said attachment means in an opening in the protective clothing, the arrangement being such that the cord can be readily attached or detached.

Preferably, the means for attachment is a toggle engaging in the opening.

The term 'cord' as used herein means any type of flexible elongate material and can include ribbon, tape, string and so on.

Thus the object, whether it be a toy or eating implement, can be readily attached or detached by an adult but cannot be separated by a small child wearing the bib or apron. One of the advantages of the invention is that a toy can be attached to a bib and used to pacify a child sitting in its high chair waiting for its food to be prepared and can thereafter be removed to be replaced by an eating implement. The child is unable to throw away the toy or the eating implement and thus there is no risk of the adult falling over unnoticed toys and so on lying on the floor nor is there a child screaming for the lost article.

A further advantage lies in the fact that the toys or other objects can be removed from the bib or apron while one or the other are being cleaned.

BRIEF DESCRIPTION OF THE DRAWINGS

The invention is illustrated by way of example in the accompanying drawings in which.

DESCRIPTION OF THE PREFERRED EMBODIMENT

Figure 1:
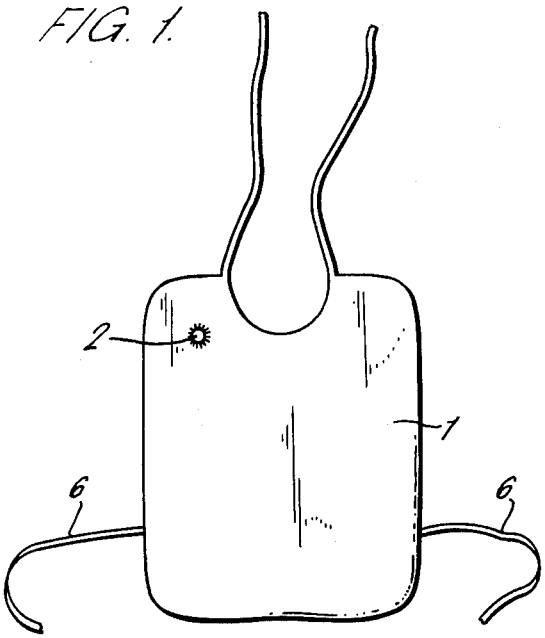
FIG. 1 is a baby's bib.
Figure 2:
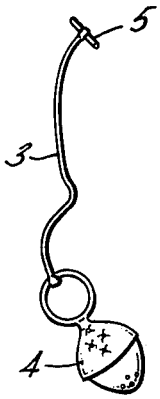
FIG. 2 illustrates a toy attached to the end of a cord.
Figure 3:
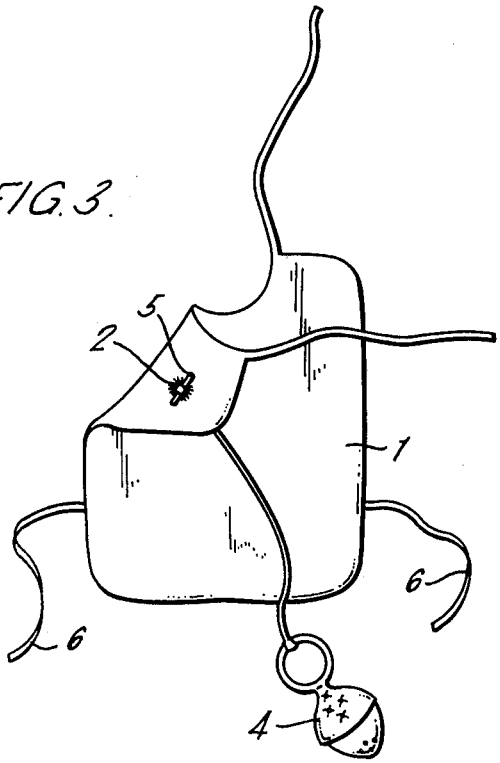
FIG. 3 shows the cord of FIG. 2 attached to the bib of FIG. 1.

Referring firstly to FIGS. 1 to 3 of the drawings a bib 1 has a reinforced buttonhole stitched opening 2. A cord 3 of flexible material has a toy 4 permanently attached to one end and a wooden toggle 5 also permanently attached at the other. As shown in FIG. 3 the toggle 5 engages through the opening 2 thus providing a simple form of attachment which, although detachable by an older child or an adult cannot be detached by the wearer of the bib.

Of course the bib may have tie-up tapes 6 or strap to be fixed around the waist of the wearer of the bib, either by simply tying or by the use of one or more press-studs.

Figure 4:
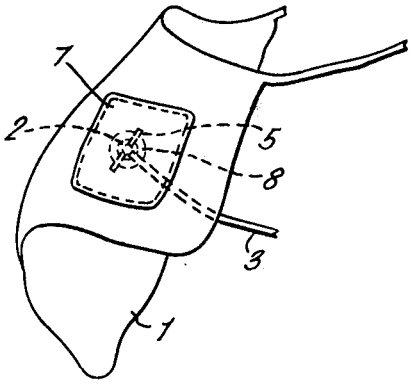
FIG. 4 is a fragmentary view of the rear of a modification of the bib shown in FIGS. 1 to 3.

Further, the bib may have a whole or partial backing as shown in FIG. 4 so that when the toggle is inserted it lies between the bib 1 and the backing 7. The opening 2 in the bib may be re-inforced by a metal or plastic ring 8 stitched to surround the opening.

Needless to say the form of attachment need not be a toggle as illustrated. It could for example be a simple button which is permanently attached to the cord 3.

I claim:

1. An object-retaining baby's bib comprising:

a bib having front and back surfaces and having an opening defined therein;

means for reinforcing said opening;

flexible inelastic cord means having first and seconds ends;

a toggle permanently secured to said first end of said cord means, said toggle being adapted to be inserted through said opening from said front surface and be detachably engaged by said back surface, whereby said cord means is suspended along said front surface;

an article of use permanently secured to said second end of said cord means.

2. The bib according to claim 1 wherein said means for reinforcing comprises stitching around the periphery of said opening.

3. The bib according to claim 2 further comprising a piece of backing material secured to said back surface about said opening to define a pocket-like region in which said toggle resides when engaged by said back surface.

4. The bib according to claim 1 wherein said means for reinforcing comprises a rigid ring surrounding said opening.

5. The bib according to claim 1 further comprising backing material secured to said back surface about said opening to define a pocket between said backing material and said back surface in which said toggle resides when engaged by said back surface.

6. The bib according to claim 5 and further comprising means for securing said bib around the waist of the wearer.

* * * * *